US009049945B2

(12) United States Patent
You et al.

(10) Patent No.: US 9,049,945 B2
(45) Date of Patent: Jun. 9, 2015

(54) SPACE ADJUSTMENT MECHANISM FOR A CHAIR

(71) Applicant: LERADO (ZHONG SHAN) INDUSTRIAL CO., LTD, Zhong Shan, Guang Dong (CN)

(72) Inventors: Youn-Fu You, Chang Hua (TW); Kuang-Neng Cheng, Chiayi County (TW); Janwillem Bouwknegt, Ed Leiden (NL); Martijn Hans Van Gelderen, Ed Leiden (NL); Herman Van Der Vegt, Ed Leiden (NL)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 135 days.

(21) Appl. No.: 13/868,813

(22) Filed: Apr. 23, 2013

(65) Prior Publication Data

US 2013/0278034 A1 Oct. 24, 2013

(30) Foreign Application Priority Data

Apr. 23, 2012 (CN) ..... 2012 2 0176302 U

(51) Int. Cl.
*A47D 1/00* (2006.01)

(52) U.S. Cl.
CPC ..... *A47D 1/004* (2013.01); *A47D 1/002* (2013.01)

(58) Field of Classification Search
USPC ..... 297/423.25, 423.38, 440.22, 344.14
See application file for complete search history.

(56) References Cited

U.S. PATENT DOCUMENTS

| | | | | | |
|---|---|---|---|---|---|
| 2,439,869 | A * | 4/1948 | Sharp | 297/296 |
| 3,542,419 | A * | 11/1970 | Spinola | 297/130 |
| 4,520,515 | A * | 6/1985 | Hatala | 4/579 |
| 6,149,236 | A * | 11/2000 | Brauning | 297/301.2 |
| 6,921,135 | B2 * | 7/2005 | Ellis et al. | 297/344.18 |
| 2003/0102700 | A1 * | 6/2003 | Lin | 297/183.9 |

* cited by examiner

*Primary Examiner* — David R Dunn
*Assistant Examiner* — Jody Giacoman
(74) *Attorney, Agent, or Firm* — Muncy, Geissler, Olds & Lowe, P.C.

(57) ABSTRACT

A space adjustment mechanism for a chair includes a seat base unit, a backrest sliding unit and an angular cross linking unit. The seat base unit has a body portion for accommodating an occupant sitting thereupon, and a shaft extending downward from the body portion. The backrest sliding unit has a backrest connected with a slidable rack which is slidably engaged with the body portion and formed with a pair of tubular sections. The angular cross linking unit has a first extending member for telescopically engaged with the shaft, and a pair of second extending members for telescopically engaged with the tubular sections. By this mechanism, when the first extending member is moving downward along the shaft, the backrest is driven to move backward for accommodating elder child, when the first extending member is moving upward, the backrest is driven to move forward for accommodating little child.

15 Claims, 10 Drawing Sheets

SPACE ADJUSTMENT MECHANISM FOR A CHAIR

BACKGROUND OF THE INVENTION

1. Field of the Invention

The present invention relates to a space adjustment mechanism for a chair, especially to a mechanism capable of changing the position of the backrest for accommodating the children of different growing stages.

2. Description of the Related Art

Children's body is changing day by day in their growing stages. If a child's body is too small to sit in a larger chair, the child's back can not touch with the backrest to get sufficient support; oppositely, if a child's body is too big to sit in a smaller chair, the thigh of the child can not get full support by the seat, unless the seatback is capable of moving backward.

It is a long desire to improve the function as well as provide a new structure of a chair for children thereby accommodating the growing children occupant in a comfortable way.

SUMMARY OF THE INVENTION

For fulfilling the above-mentioned long need and eliminating the drawbacks of fixed-size children chair, the present invention provides a space adjustment mechanism for a chair includes a seat base unit, a backrest sliding unit and an angular cross linking unit.

The seat base unit has a body portion for accommodating an occupant sitting thereupon, and a shaft extending downward from the body portion.

The backrest sliding unit has a backrest connected with a slidable rack which is slidably engaged with the body portion and formed with a pair of tubular sections.

The angular cross linking unit has a first extending member for telescopically engaged with the shaft under the seat base, and a pair of second extending members for telescopically engaged with the tubular sections.

By this mechanism, when the first extending member is moving downward along the shaft, the backrest is driven to move backward for accommodating elder child, when the first extending member is moving upward, the backrest is driven to move forward for accommodating little child..

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
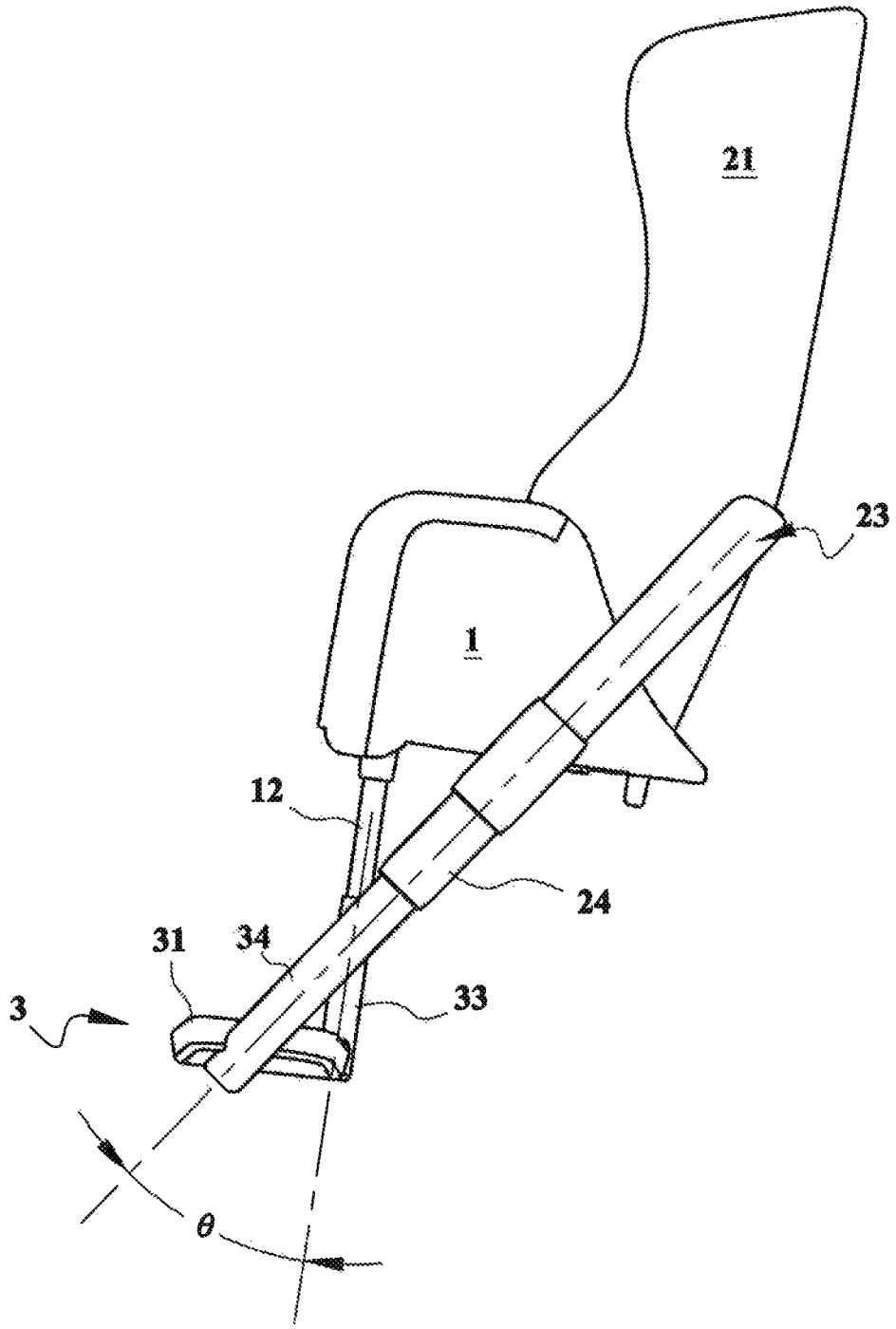
FIG. 1 is a schematic side view showing an embodiment of the space adjustment mechanism mounted for chair according to the present invention.
Figure 2:
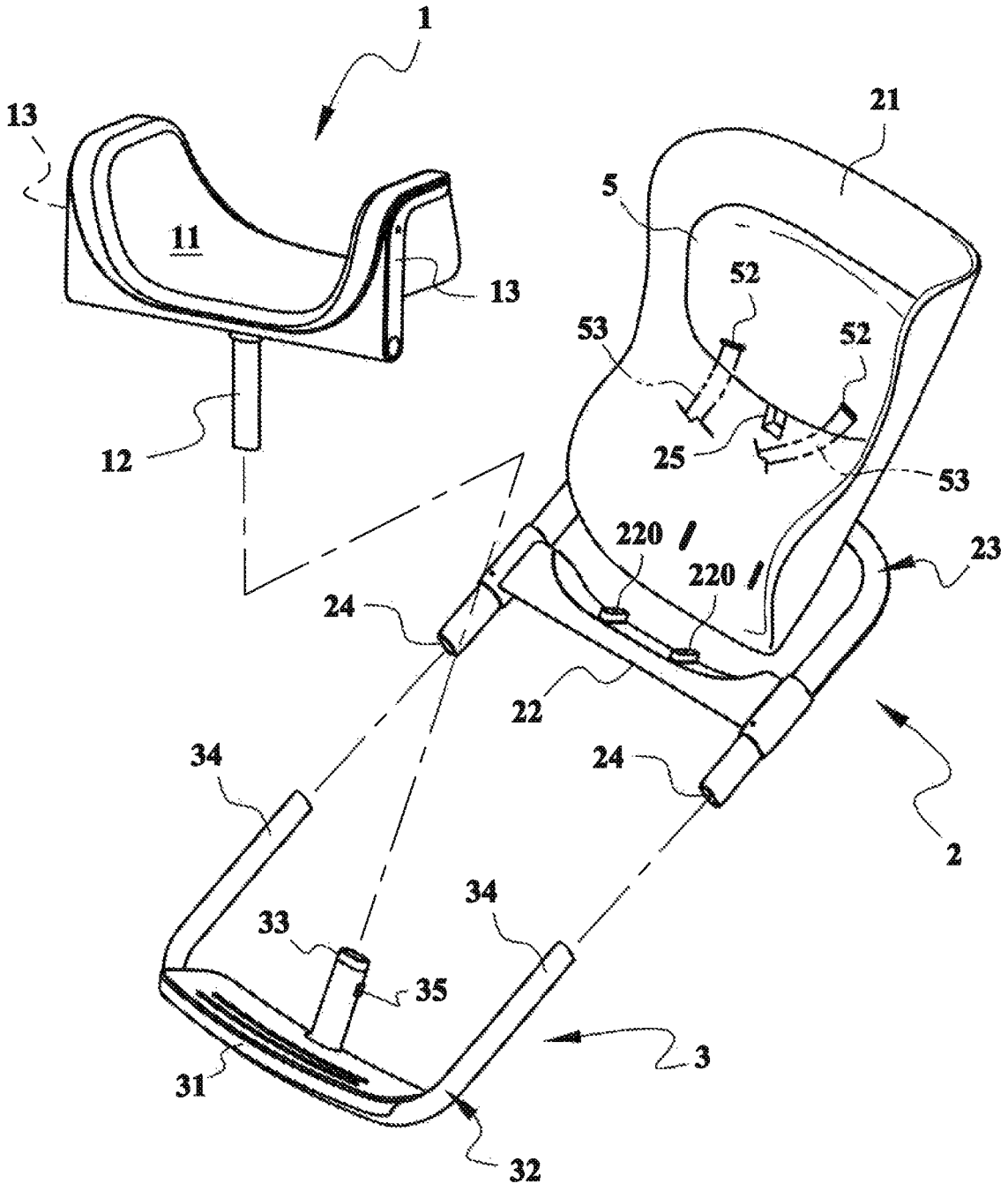
FIG. 2 is an exploded perspective view of an embodiment of the space adjustment mechanism for a chair according to the present invention.
Figure 3:
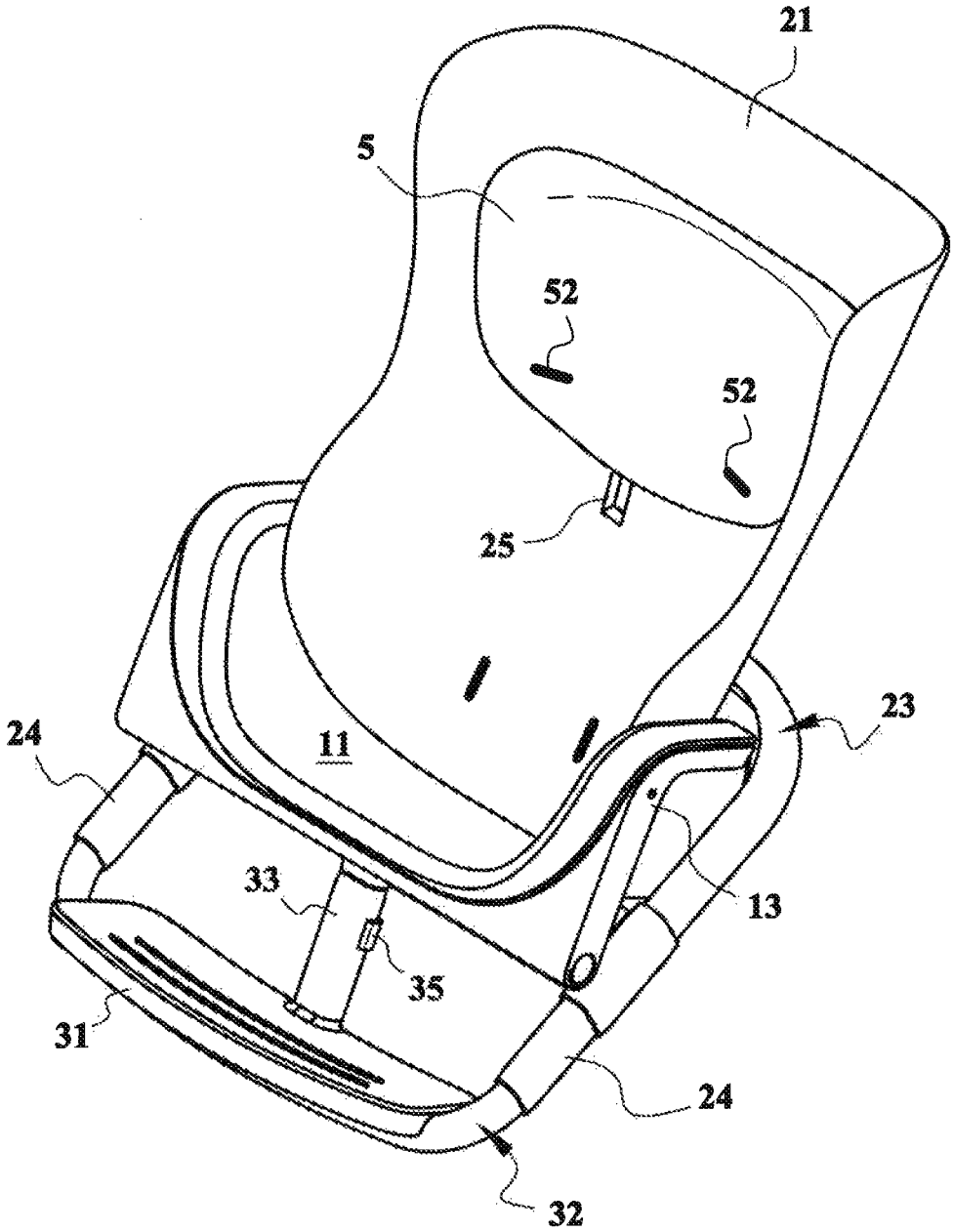
FIG. 3 is a perspective top view showing a chair equipped with an embodiment of the space adjustment mechanism according to the present invention.

Referring to FIGS. 1 to 3, the space adjustment mechanism for a chair according to the present invention is basically including a seat base unit 1, a backrest sliding unit 2 and an angular cross linking unit 3.

The seat base unit 1 has a body portion 11 for accommodating an occupant to sit thereupon, and a shaft 12 extending downward from down side of the body portion 11.

Figure 4:
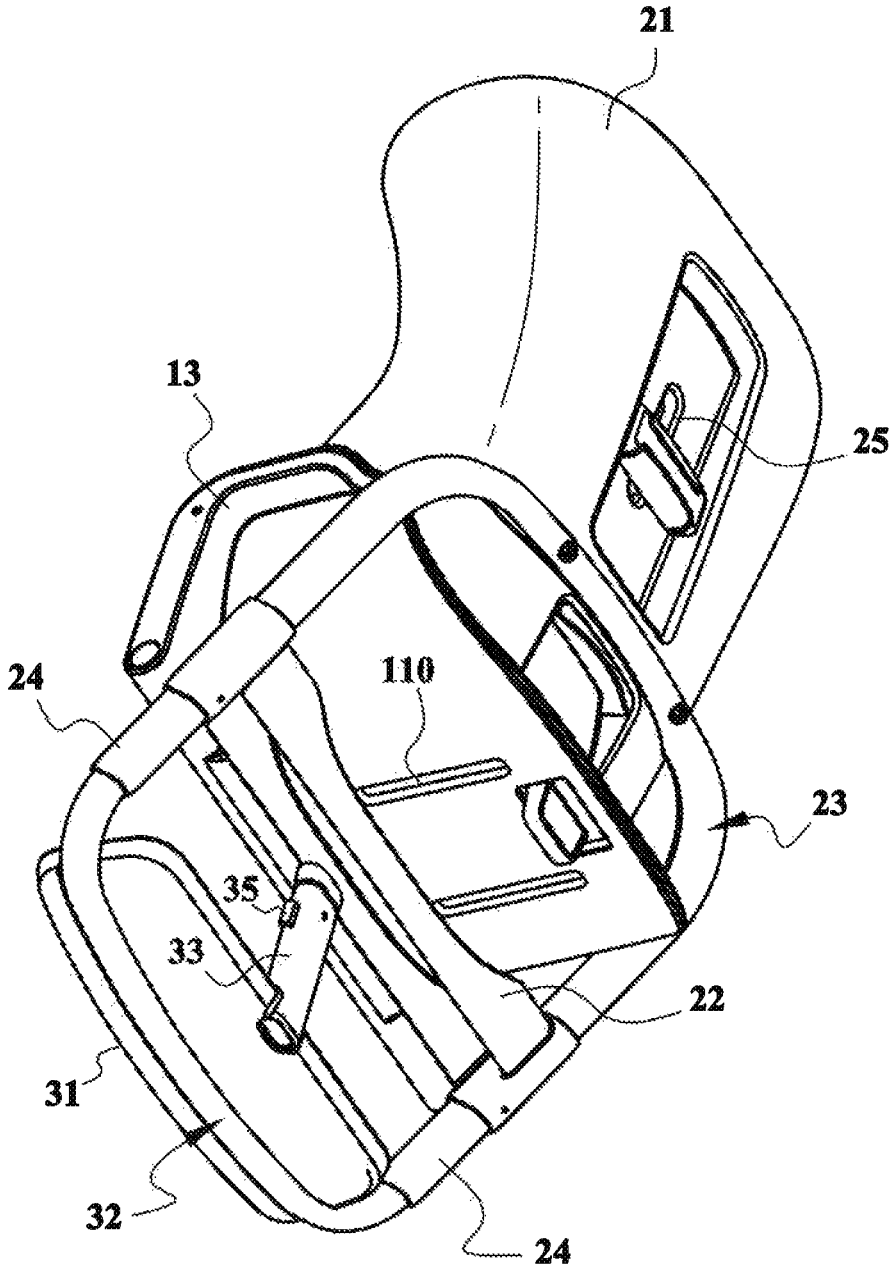
FIG. 4 is a perspective bottom view showing a chair equipped with an embodiment of the space adjustment mechanism according to the present invention.
Figure 5:
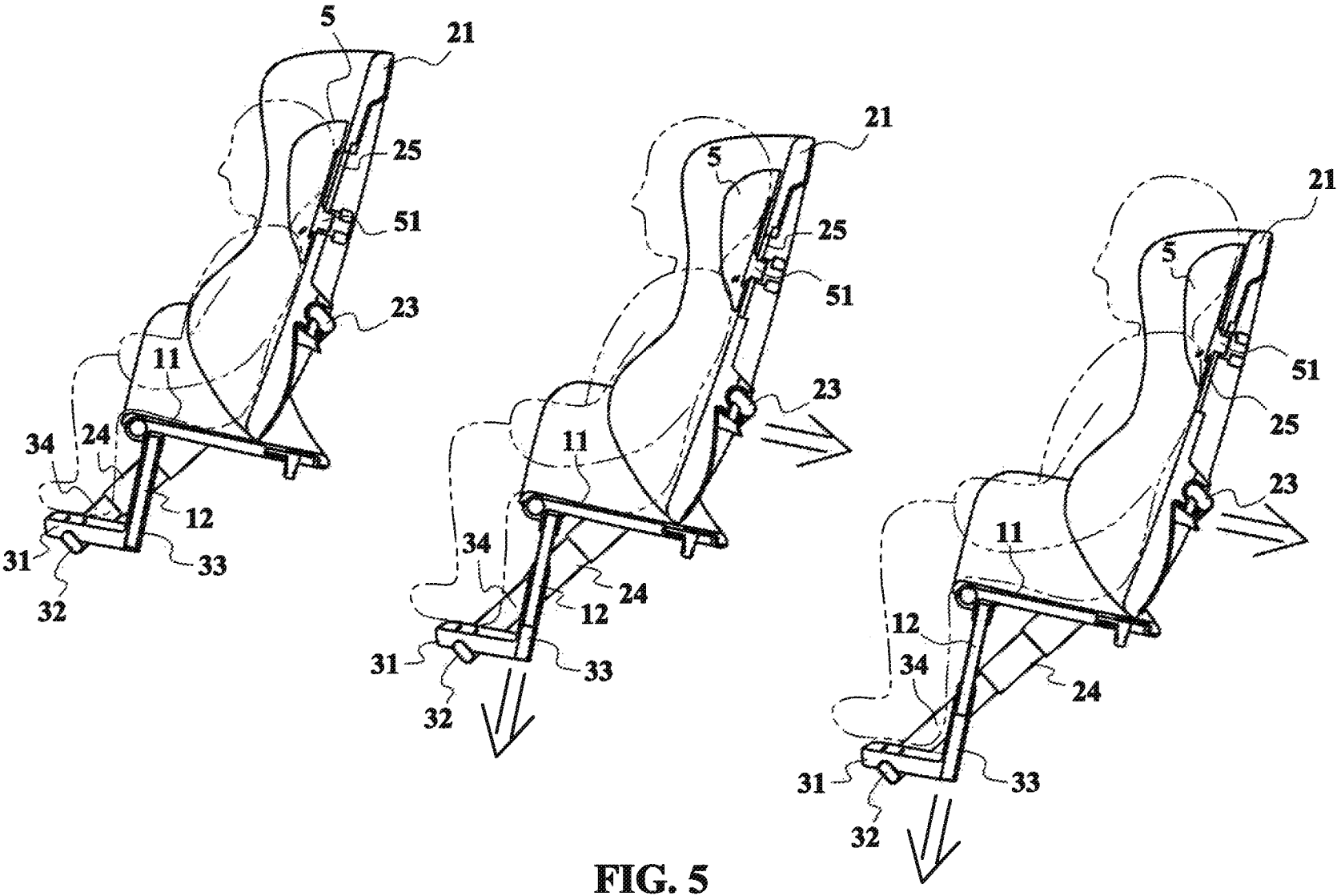
FIG. 5 is a schematic side view showing a chair capable of accommodating children in different growing stages, by manipulation of a space adjustment mechanism according to the present invention mounted on such a chair.

The backrest sliding unit 2 has a backrest 21 connected with a slidable rack 23 which has at least one portion slidably engaged with the body portion 11 and formed with a pair of tubular sections 24 parallel to each other. For instance, as shown in FIGS. 2 and 4, the backrest sliding unit 2 may be equipped with a bridging member 22 connected between the pair of tubular sections 24 for slidably engaging with the down side of the body portion 11. Preferably, the down side of the body portion 11 is formed with at least a guiding slot 110, and the bridging member 22 is formed with at least a protruded portion 220 for slidably engaging with the guiding slot 110, by this way to ensure the backrest 21 can moving smoothly without wobble.

Figure 9:
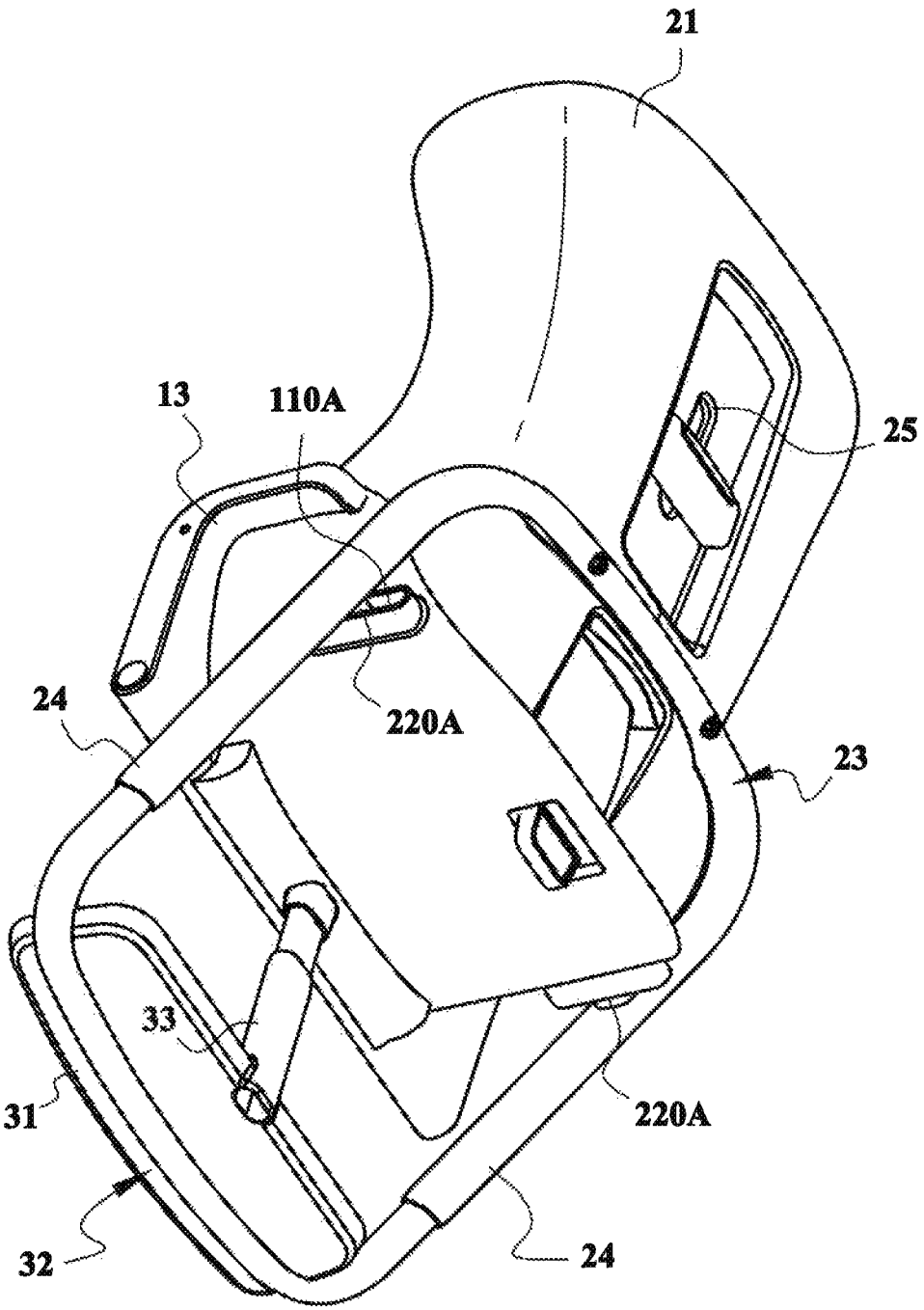
FIG. 9 is a bottom perspective view showing an alternative embodiment of the space adjustment mechanism for a chair according to the present invention.
Figure 10:
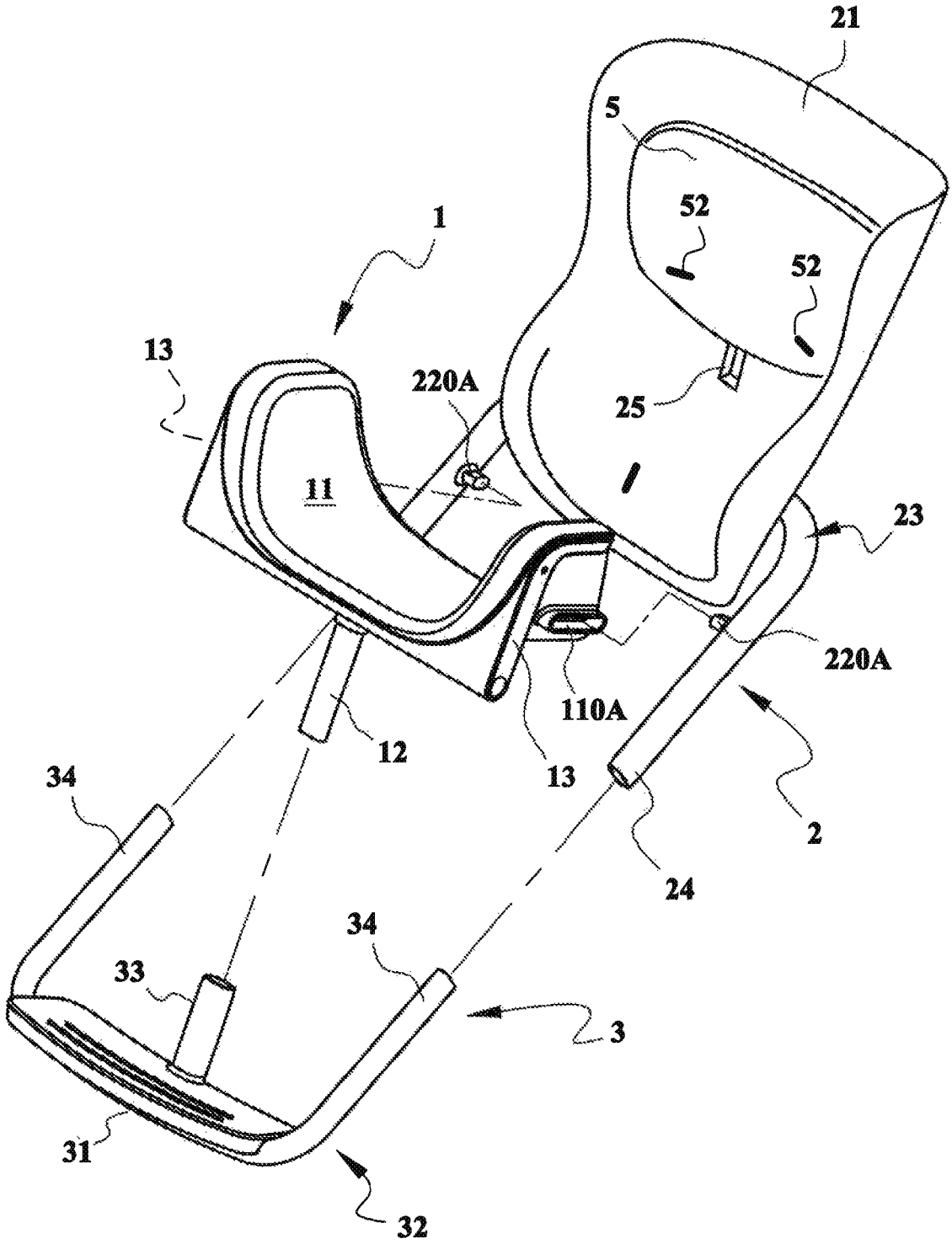
FIG. 10 is an exploded perspective view showing an alternative embodiment of the space adjustment mechanism for a chair according to the present invention.

As shown in FIGS. 9 to 11, the backrest sliding unit 2 may alternatively formed with a pair of inward protruding portions 220A for slidably engaging with the body portion 11. Preferably, the opposite sides of the body portion 11 are formed with a pair of guiding slots 110A for slidably engaging with the inward protruding portions 220A, by this way its also capable of ensuring the backrest 21 to move smoothly without wobble.

As shown in FIG. 1, the angular cross linking unit 3 of this embodiment is featured with having a first extending member 33 and a pair of second extending members 32 formed with a fixed angle θ less than 90 degrees. The first extending member 33 is telescopically engaged with the shaft 12, and a pair of second extending members 34 is telescopically engaging with the tubular sections 24 of the backrest sliding unit 2.

The angular cross linking unit 3 may be permanently connected with a footrest 31. For instance, the angular cross linking unit 3 may be formed with an intermediate portion 32 between the pair of second extending members 34, and a footrest 31 is connected on the intermediate portion 32 either by screws or rivets, or by any traditional connecting means.

Preferably, a spring-biased locking element 35 is operatively mounted between the shaft 12 and the first extending member 33, for locking the angular cross linking unit 3 against a relative moving between the seat base unit 1 and the backrest sliding unit 2.

Figure 6:
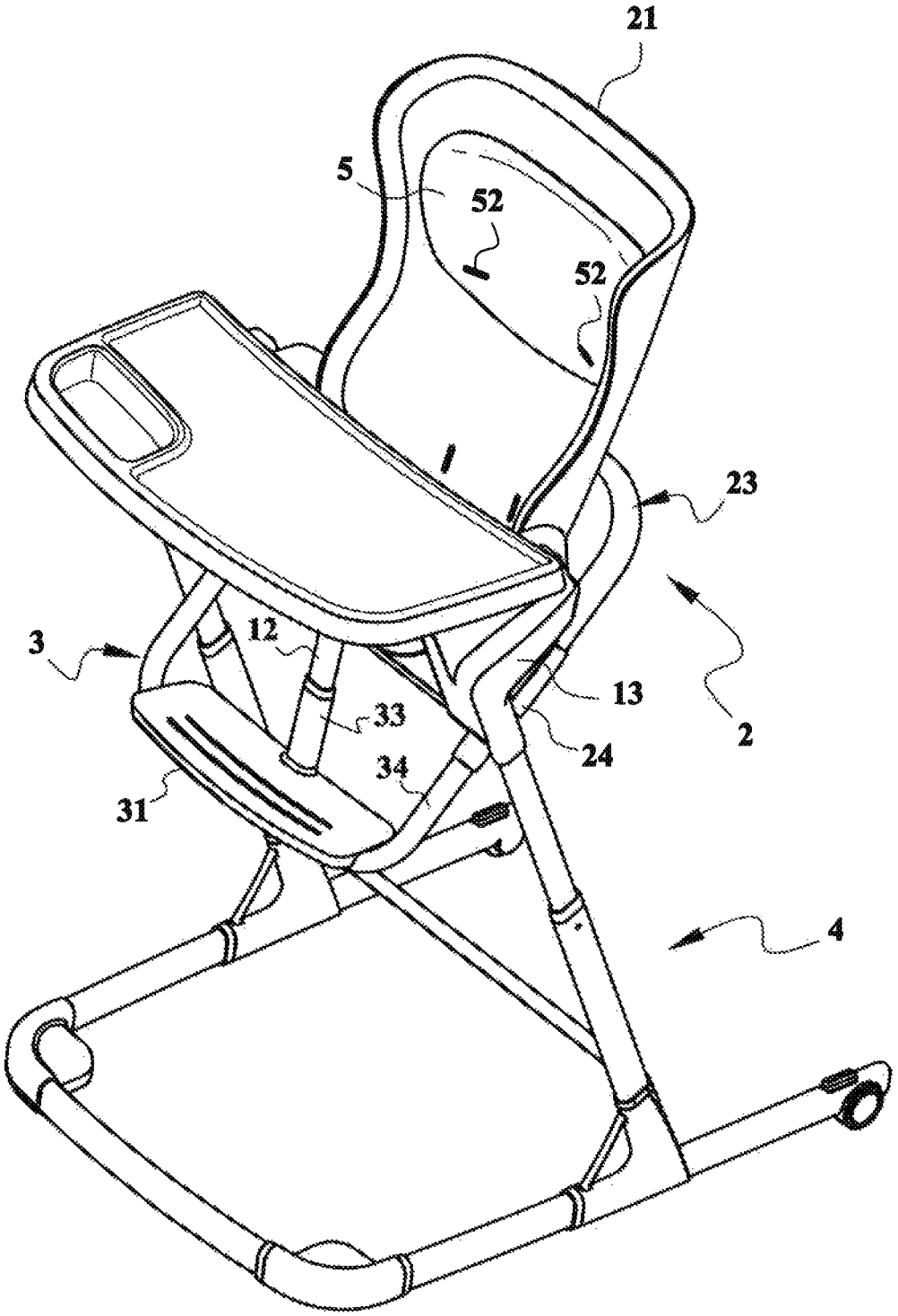
FIG. 6 is a perspective view showing a high chair equipped with an embodiment of the space adjustment mechanism according to the present invention.

According to the present invention, as being schematically illustrated in FIG. 6, when the first extending member 33 is adjusted to move downward along the shaft 12, the backrest 21 shall be driven by the angular cross linking unit 3 to move backward for suitably accommodating an elder child to sit in with enough sitting area, and when the first extending member 33 is adjusted to move upward, the backrest 21 shall be driven to move forward so as to suitably accommodate a little child with full back support.

Figure 7:
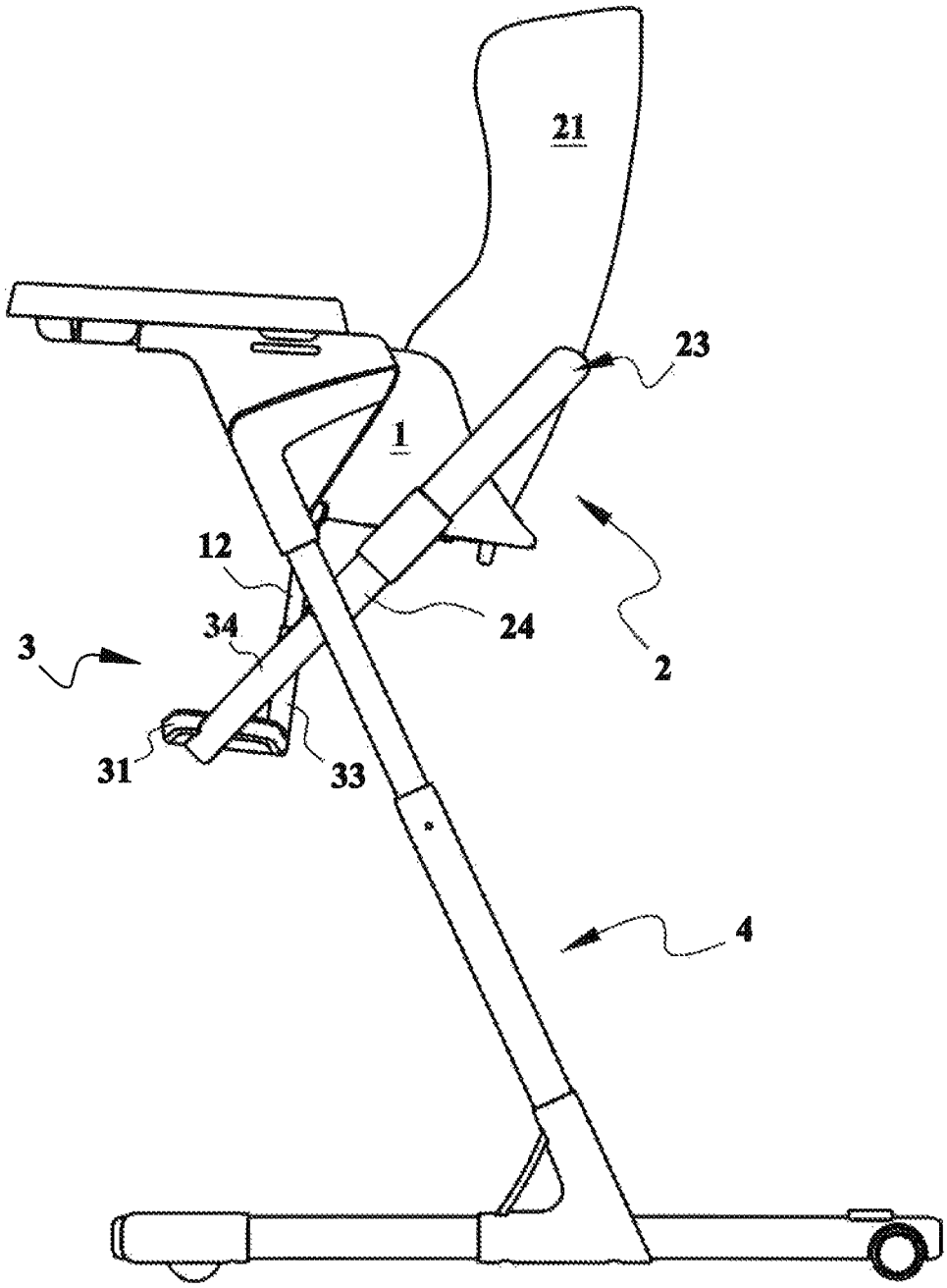
FIG. 7 is a side view showing a high chair equipped with an embodiment of the space adjustment mechanism according to the present invention.
Figure 8:
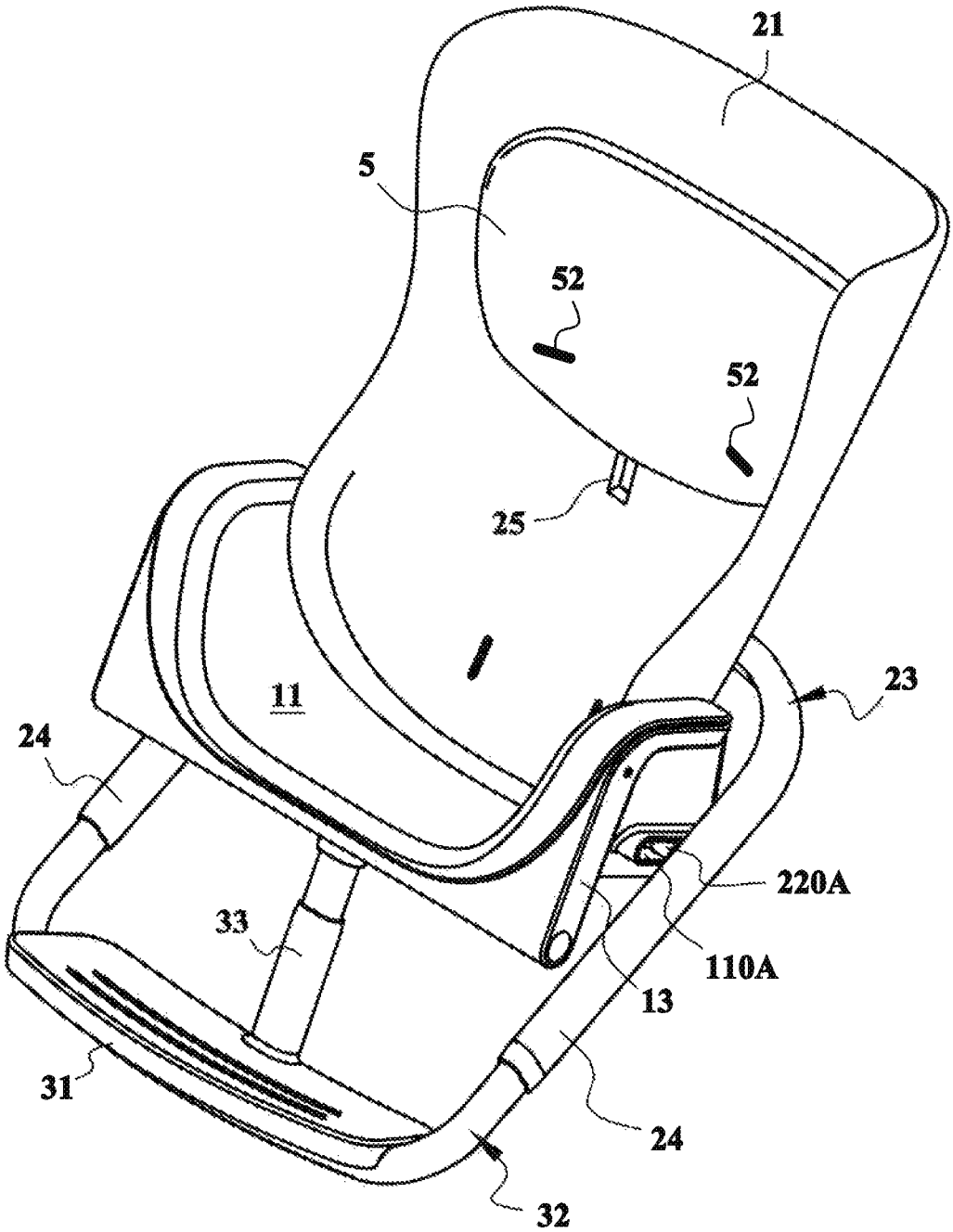
FIG. 8 is a perspective view showing an alternative embodiment of the space adjustment mechanism mounted on a chair according to the present invention.

Referring to FIGS. 7 and 8, the body portion 11 may further to be formed with a pair of connecting portions 13 on the opposite sides thereof for connecting with a high chair frame 4. By this way, the position of the backrest 21 of a high chair shall become adjustable by moving and positioning the first extending member 33 in either going upward or downward.

The backrest 21 may be formed with a vertical guiding slot 25 as shown in FIGS. 2 and 4 for either positioning or guiding a head-piece 5 to move along the backrest 21 therefore let the head-piece 5 becoming capable of positioning in a variant of heights.

Preferably, the head-piece 5 may also be formed with a pair of slits 52 and equipped with a pair of shoulder belts 53 having at least one end connected to the backrest 21 and threaded through the pair of shoulder belt 53.

By this way, the upper end of the shoulder belts 53 shall always kept to follow the head-piece 5, i.e. when the chair of this embodiment is accommodating an elder occupant, head-piece 5 can carry the upper end of the shoulder belt 53 moving upward; when the chair of this embodiment is accommodating a little occupant, head-piece 5 can carry the upper end of the shoulder belt 53 moving downward.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A space adjustment mechanism for a chair, including:

a seat base unit, having a body portion for supporting an occupant sitting thereupon, and a shaft extending downward from the body portion;

a backrest sliding unit, having a backrest connected with a slidably rack, wherein the slidably rack is slidably engaged with the body portion and formed with a pair of tubular sections;

an angular cross linking unit, having a first extending member telescopically engaged with the shaft, and a pair of second extending members telescopically engaged with the tubular sections.

2. The space adjustment mechanism for a chair according to claim 1, wherein the backrest sliding unit has a bridging member connected between the pair of tubular sections slidably engaged with a down side of the body portion.

3. The space adjustment mechanism for a chair according to claim 2, wherein the down side of the body portion is formed with at least a guiding slot for engaging with the bridging member.

4. The space adjustment mechanism for a chair according to claim 3, Wherein the bridging member is formed with at least a protruded portion slidably engaged in the guiding slot.

5. The space adjustment mechanism for a chair according to claim 1, wherein the backrest sliding unit is formed with a pair of inward protruding portions for slidably engaging with the body portion.

6. The space adjustment mechanism for a chair according to claim 5, wherein the body portion is formed with a pair of guiding slots for slidably engaging with the inward protruding portions.

7. The space adjustment mechanism for a chair according to claim 1, wherein the first extending member and the second extending members are formed with a fixed angle less than 90 degrees.

8. The space adjustment mechanism for a chair according to claim 1, wherein the angular cross linking unit is connected with a footrest.

9. The space adjustment mechanism for a chair according to claim 1, wherein the angular cross linking unit has an intermediate portion formed between the pair of second extending members.

10. The space adjustment mechanism for a chair according to claim 9, wherein the intermediate portion is connected with a footrest.

11. The space adjustment mechanism for a chair according to claim 1 further includes a spring-biased locking element operatively mounted between the shaft and the first extending member, for locking the angular cross linking unit against a relative moving between the seat base unit and the backrest sliding unit.

12. The space adjustment mechanism for a chair according to claim 1, wherein the body portion has a pair of connecting portions formed on opposite sides thereof for connecting with a high chair frame.

13. The space adjustment mechanism for a chair according to claim 1, wherein the backrest is formed with a vertical guiding slot for guiding a head-piece to move along the backrest and capable of positioning in a variant of heights.

14. The space adjustment mechanism for a chair according to claim 1 further includes a head-piece capable of moving along the backrest and positioning in a variant of heights.

15. The space adjustment mechanism for a chair according to claim 14 wherein the head-piece has a pair of slits, and a pair of shoulder belts has one end connected to the backrest and threaded through the pair of shoulder belt.

* * * * *